US007678233B2

(12) United States Patent
Beselt

(10) Patent No.: US 7,678,233 B2
(45) Date of Patent: Mar. 16, 2010

(54) MACHINE DIRECTION SENSOR SYSTEM WITH CROSS DIRECTION AVERAGING

(75) Inventor: Ron E. Beselt, Burnaby (CA)

(73) Assignee: Honeywell ASCA, Inc., Mississagua (CA)

( * ) Notice: Subject to any disclaimer, the term of this patent is extended or adjusted under 35 U.S.C. 154(b) by 604 days.

(21) Appl. No.: 11/513,476

(22) Filed: Aug. 31, 2006

(65) Prior Publication Data

US 2007/0151689 A1 Jul. 5, 2007

Related U.S. Application Data

(60) Provisional application No. 60/754,769, filed on Dec. 29, 2005.

(51) Int. Cl.
*D21F 7/06* (2006.01)
*G01N 33/34* (2006.01)

(52) U.S. Cl. ..... 162/263; 162/198; 162/252; 162/253; 162/262; 162/DIG. 6; 162/DIG. 10; 250/559.1; 356/431; 700/129; 73/159

(58) Field of Classification Search ..... 162/199, 162/252, 253, 262, 263, DIG. 6, DIG. 10, 162/DIG. 11, 198; 250/559, 559.1, 334, 250/332, 339.1; 356/429–431; 700/127–129; 702/84; 73/159
See application file for complete search history.

(56) References Cited

U.S. PATENT DOCUMENTS

| | | | | | |
|---|---|---|---|---|---|
| 3,552,203 | A * | 1/1971 | Freeh | 73/159 |
| 3,610,899 | A * | 10/1971 | Dahlin | 702/84 |
| 3,914,585 | A * | 10/1975 | Wilhelm et al. | 700/129 |
| 4,000,402 | A * | 12/1976 | Higham | 700/129 |
| 4,910,688 | A * | 3/1990 | Amini | 702/33 |
| 5,327,770 | A * | 7/1994 | Hindle | 73/863 |
| 5,898,589 | A | 4/1999 | Shakespeare et al. | |
| 6,538,743 | B2 * | 3/2003 | Shakespeare et al. | 356/429 |
| 6,564,117 | B1 | 5/2003 | Chen et al. | |
| 6,743,337 | B1 * | 6/2004 | Ischdonat | 162/198 |
| 2002/0104637 | A1 * | 8/2002 | Koivukunnas et al. | 162/263 |

* cited by examiner

*Primary Examiner*—Eric Hug
(74) *Attorney, Agent, or Firm*—Cascio, Schmoyer & Zervas

(57) ABSTRACT

Disclosed is a machine direction measurement system having an increased cross direction sampling area (significantly larger than the natural sensor measurement window) to generate a more representative and stable machine direction reading of the process. In effect, the sensor should have as wide a coverage area as possible without having to resort to the expense of measuring the entire width of the sheet.

13 Claims, 4 Drawing Sheets

MACHINE DIRECTION SENSOR SYSTEM WITH CROSS DIRECTION AVERAGING

CROSS REFERENCE TO RELATED APPLICATION

The present application claims priority from U.S. Provisional Application No. 60/754,769, filed Dec. 29, 2005.

BACKGROUND OF THE INVENTION

1. Field of the Invention

This invention generally relates to measuring process variables in a processing system. More specifically, the present invention relates to a sensor system for measuring process variables in the machine direction, with cross direction averaging, in a continuous flat sheet process such as a paper making process.

2. Background Art

In many continuous flat sheet formation processes such as paper making, properties of the sheet material can be tracked in two perpendicular directions: the machine direction (MD), which is the direction of movement of the sheet material during production; and cross machine direction (CD), which is perpendicular to the MD or across the sheet during production.

In these continuous flat sheet processes, it would be desirable to track the change of certain process variables along the machine direction to produce gradients that can be used for monitoring, control, and optimization. Measurements of the process can be made by fixing a series of sensors, typically designed for scanning systems, on fixed brackets in corresponding cross direction locations along the machine length. Due to their scanner based heritage, the measurement windows (sampling apertures) are very small in comparison to the width of the process, however the true machine direction measurement is really a process average of the entire cross direction width. Sampling a very small percentage of the sheet leads to a technical problem where cross direction variations would significantly influence the results of machine direction gradients due to sensor alignment, sheet wander, local streak generation, etc.

SUMMARY OF THE INVENTION

An object of this invention is to provide a machine direction sensor system in a continuous flat sheet process.

Another object of the present invention is to provide a continuous flat sheet process with a machine direction sensor system having cross-direction averaging.

These and other objectives are attained, in accordance with this invention, with a machine direction measurement system having an increased cross direction sampling area (significantly larger than the natural sensor measurement window) to generate a more representative and stable machine direction reading of the process. In effect, the sensor may have as wide a coverage area as possible without having to resort to the expense of measuring the entire width of the sheet.

One embodiment of the invention is a machine direction sensor system with cross direction averaging, for measuring process variables in a continuous flat sheet process having a machine direction and a cross direction. This sensor system comprises one or more sensors and a control. The one or more sensors are provided for taking a plurality of measurements along a cross directional section of the continuous flat sheet. The controller is used for generating a series of signals representing said measurements, and a controller for receiving said signals and for using said signals to average said measurements into a single reading. In a preferred embodiment the one or more sensors includes a sensor head, and a driver for moving the sensor head back and forth across said cross directional section.

Further benefits and advantages of the invention will become apparent from a consideration of the following detailed description, given with reference to the accompanying drawings, which specify and show preferred embodiments of the invention.

DETAILED DESCRIPTION OF THE PREFERRED EMBODIMENTS

Figure 1:
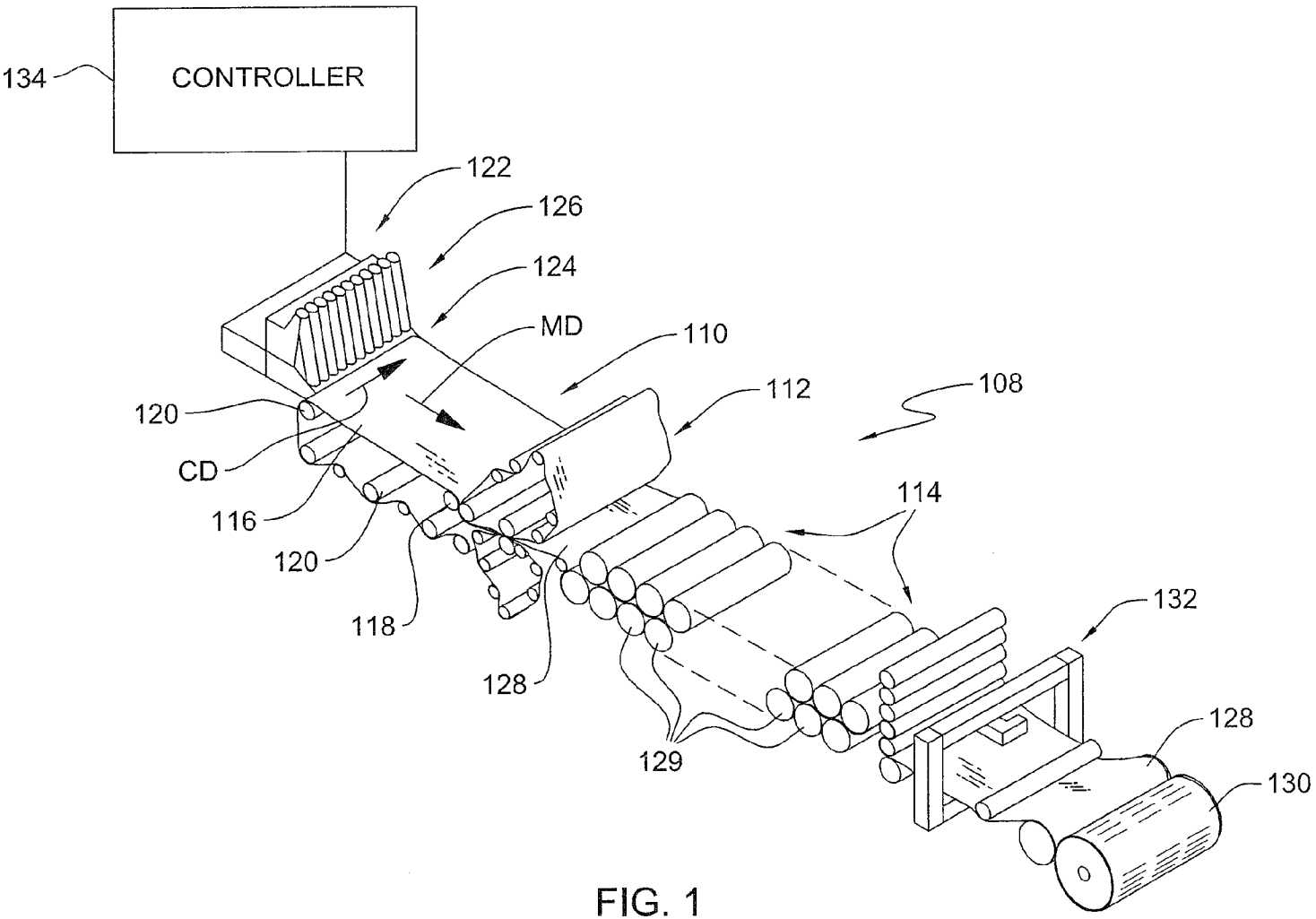
FIG. 1 is a perspective view of a papermaking machine embodying the present invention.
Figure 2:
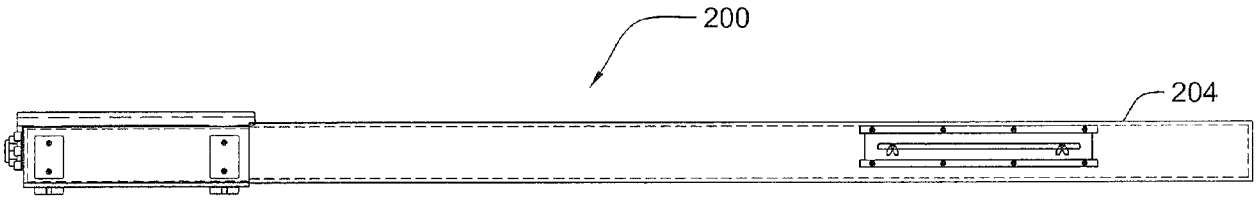
FIG. 2 is a top view of a preferred sensor system in accordance with the present invention.
Figure 3:
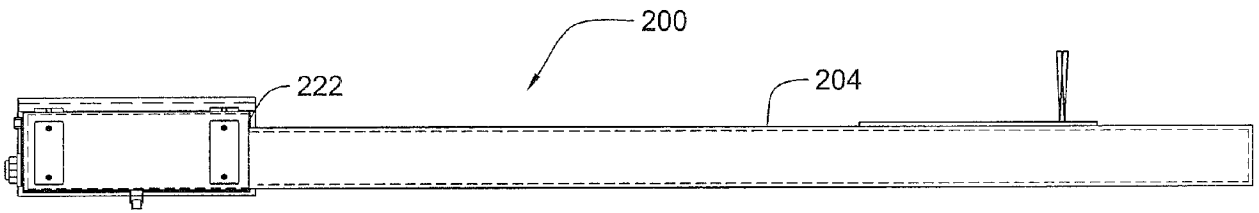
FIG. 3 is a side view of the sensor system of FIG. 2.

FIG. 1 schematically illustrates a paper making machine 108 having a Fourdrinier wire section 110, a press section 112, and a dryer section 114. The midsection of dryer section 114 is broken away in FIG. 1 to indicate that other web processing equipment, such as a sizing section, additional dryer sections and other equipment well known to those skilled in the art, may be included within the machine 108.

The Fourdrinier wire section 110 comprises an endless wire belt 116 wound around a drive roller 118 and a plurality of guide rollers 120 properly arranged relative to the drive roller 118. The drive roller 118 is driven for rotation by an appropriate drive mechanism (not shown) so that the upper side of the endless wire belt 116 moves in the direction of the arrow labeled MD that indicates the machine direction for the process. A headbox 122 receives pulp slurry, i.e. paper stock, that is discharged through a slice lip 124, controlled using a plurality of CD actuators 126, slice screws as illustrated in FIG. 1, onto the upper side of the endless wire belt 116. The pulp slurry is drained of water on the endless wire belt 116 to form a web 128 of paper. The water drained from the pulp slurry to form the web 128 is called white water that contains pulp in a low concentration and is collected under the Fourdrinier wire section 110 and recirculated in the machine 108 in a well-known manner.

The web 128 so formed is further drained of water in the press section 112 and is delivered to the dryer section 114. The dryer section 114 comprises a plurality of steam-heated drums 129. The web 128 may be processed by other well known equipment located in the MD along the process and is ultimately taken up by a web roll 130. Equipment for sensing characteristics of the web 128, represented at 132, is located substantially adjacent to the web roll 130. It is noted that other forms of sensing equipment can be used in the present invention and that sensing equipment is preferably positioned at several locations along the web 128. A controller, represented at 134, is provided for controlling the operation of machine 108.

In accordance with the present invention, machine 108 is provided with a machine direction measurement system having an increased cross direction sampling area (significantly larger than the natural sensor measurement window) to generate a more representative and stable machine direction reading of the process. In effect, the sensor may have as wide a coverage area as possible without having to resort to the expense of measuring the entire width of the sheet.

FIGS. 2-5 illustrate a preferred sensor system 200 that maybe used in the present invention, and generally, system 200 includes sensor cartridge assembly 202 and housing 204. In turn, cartridge assembly 202 includes sensor head 206 and driver 210, and housing 204 includes base 212 and cover 214. Preferably, sensor head 206 is a compact optical infrared (IR) moisture sensor head, and driver 210 is a rodless air cylinder. Also, this preferred embodiment of the sensor cartridge assembly 202 further includes an optical fiber (not shown), a cable chain 216, and a solenoid valve 220. In paper making machine 108, sensing system 200 is located immediately adjacent, either above or below, the paper web 128 and extends thereacross in the cross machine direction. Sensor system 200 may be supported in the desired position in any suitable way.

Generally, sensor head 206 is provided to take a plurality of measurements of a process variable in the flat sheet process illustrated in FIG. 1, and driver 210 is provided for moving the sensor head back and forth across web 128 in the CD section. Any suitable sensor head and driver may be used in the practice of this invention; and, as indicated above, the sensor head 206 may be a compact optical IR moisture sensor head, and driver 210 may be a rodless air cylinder that drives the sensor head back and forth in a space constrained environment.

This sensor 206 is used to measure the moisture content of the area of the web 128 immediately adjacent the sensor. In particular, light from the sensor is conducted through an optical fiber (not shown) and to a remote measuring instrument that is used to obtain a measurement of the moisture content of web 128. With the preferred embodiment of the sensor system 200, the sensor head 206 is attached to air cylinder 210, allowing moisture measurements of process to be made remotely via the optical fiber. Solenoid valve 220 is used to switch the direction of the air flow through cylinder 210 to allow the cylinder to be in a forward, reverse or stop state, which allows the sensor 206 to move forward or backward or to be held in a stationary position. Cable chain 216 allows the above-mentioned optical fiber to be managed during motion of the sensor head 206.

In the operation of sensor assembly 200, the sensor 206 takes measurements of the process by averaging data collected during the motion from between the position at far end of the cylinder stroke and an intermediate position (see cylinder). Arrival of sensor 206 at either position is signaled back to a controller through the use of magnetic limit switches in the air cylinder 210. Upon triggering of limit switch, the controller can then stop data acquisition and then switch solenoid valve outputs to turn the direction of the air cylinder around for another measurement in the other direction. Typical cycle times may be, for example, around 0.5 to 1 second in length. To measure data faster than that, in the khz region, the sensor 206 may be put into a mode where the sensor is driven to the end of the cylinder 210 and stopped while data is collected at the speed of the data acquisition system.

Preferably, the sensor assembly 200 laterally extends beyond sheet 128. This offsheet location, at the left end of the sensor assembly as viewed in FIGS. 2 and 3, allows the sensor head 206 to be driven to a known location to view a standardizing material for periodic sensor calibration. This also allows the sensor to be inspected and cleaned while the paper machine is operating.

This standardization (reference) tile, represented at 222, is, for example, mounted at a distance similar to the paper position and situated in the large box end of the protective structure 204. The standardize tile is used to correct sensor readings during operation based on the assumption that the tile properties remain 'standard' during it's life. The standardize tile material is ideally spectrally flat and corresponds to a zero moisture reading. For instance, a material suitable for this purpose is called Specralon or other generic suppliers.

Figure 4:
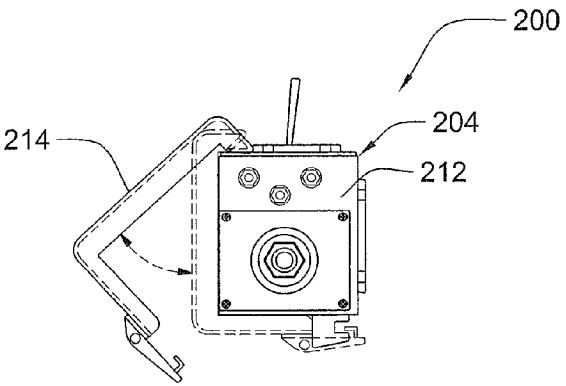
FIG. 4 is an end view of the sensor system.
Figure 5:
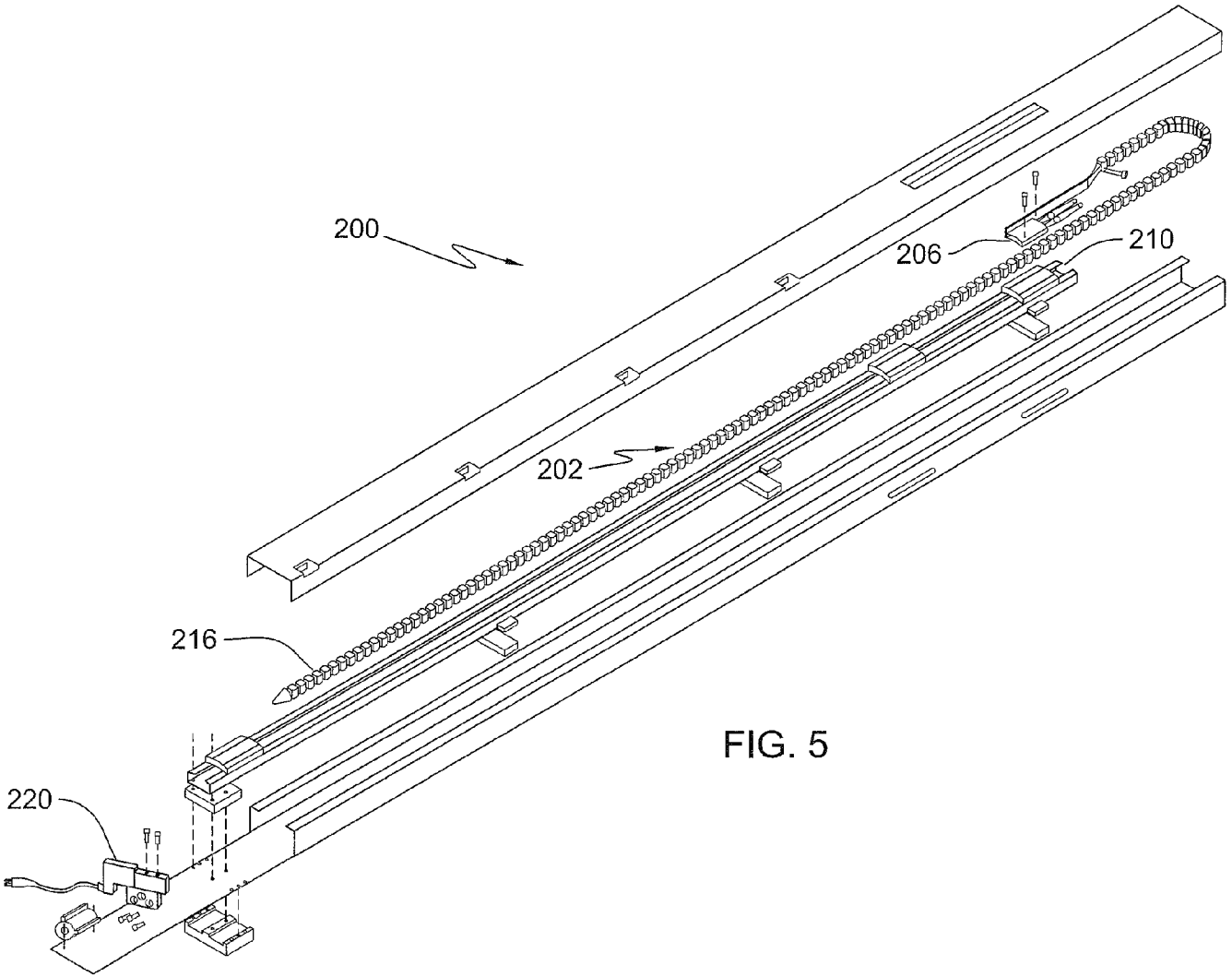
FIG. 5 is an exploded orthogonal view of the sensor system.

Cartridge assembly 202 is located within housing 204 and is preferably removably held therein. To facilitate removal of the cartridge assembly 202 from housing 204, that housing is provided with a pivotal cover. With reference to FIG. 4, this cover 214 is pivotally connected to base 212 and can be pivoted away from the base to provide access to the cartridge assembly inside the housing. Cartridge assembly 202 may be removably held in place inside the housing 204 in any suitable manner. Also, cover 214, and base 216, may be formed of metal components which captivate the cable chain 216 and optical fiber, allowing different orientations of the internals to be used.

Figure 6:
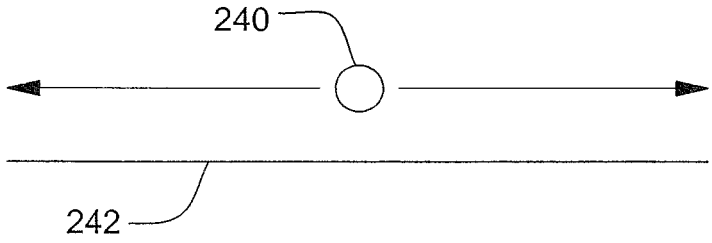
FIGS. 6-8 show various sensor heads that may be used in the practice of this invention.
Figure 7:
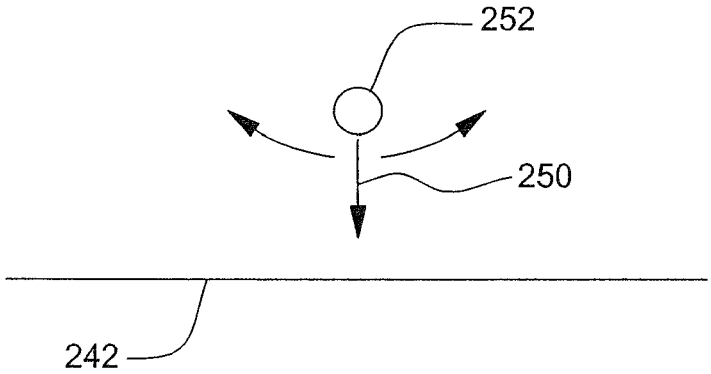
Figure 8:
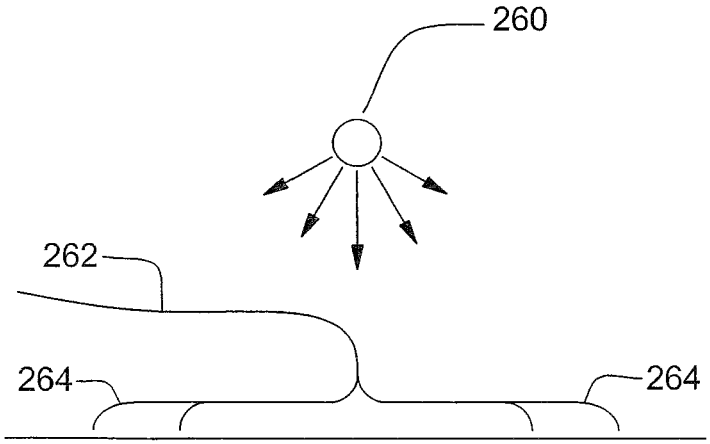

The sensor system utilized in the present invention can be constructed by allowing a cross directional section of process to be averaged into a single reading through a number of methods. These methods may include, as represented in FIG. 6, high-speed oscillation of a sensor head 240 over a CD section 242 and averaging all readings taken during each pass. Another method, represented in FIG. 7, is optical steering of sensor light paths 250 to cover a larger area than can then be averaged while the sensor head 252 is kept stationary. With reference to FIG. 8, a third method is cross direction spreading the coverage area of a single detection photodiode 260 through the use of optical fiber 262 whose collection ends 264 are distributed in the CD. Another alternate method is beam widening through the use of conventional bulk optical devices.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A machine direction sensor system with cross direction averaging, for measuring process variables in a continuous flat sheet process having a machine direction and a cross direction, the sensor system comprising:

one or more sensors for taking a plurality of measurements along a cross directional section of the continuous flat sheet, and for generating a series of signals representing said measurements; and a controller for receiving said signals and for using said signals to average said measurements into a single reading, wherein:

said one or more sensors include: a sensor head; and a driver for moving the sensor head back and forth across said cross directional section;

the driver includes an air cylinder to drive the sensor head back and forth; and the sensor system further includes:

a solenoid for controlling the direction of air flow through the air cylinder; and a cable chain for moving an optical fiber as the sensor head moves back and forth.

2. A sensor system according to claim 1, further comprising a standardization plate supported by the housing, and wherein the optical sensor is supported for movement to a position adjacent the standardization plate to calibrate the sensor head.

3. A sensor system according to claim 2, further comprising a sensor cartridge assembly, and wherein:

the sensor cartridge assembly includes the optical sensor, the air cylinder, the solenoid, and the cable chain;

the sensor cartridge assembly is releasably secured inside the housing; and the housing includes a base and a cover, said cover being movably connected to the base to provide access to the interior of the housing.

4. A sensor system according to claim 1, comprising a single sensor that is moved back and forth across the cross directional section.

5. A method for measuring process variables in a continuous flat sheet process, with cross directional averaging, said flat sheet process having a machine direction and a cross direction, the method comprising the steps of:

using a sensor on a sensor head to take a plurality of measurements along a cross directional section of the continuous flat sheet, and to generate a series of signals representing said measurements wherein the signals are conducted through an optical fiber to a controller;

moving the sensor head back and forth with a driver across said cross-directional section to make said plurality of measurements, wherein the driver includes an air cylinder that drives the sensor head, wherein a solenoid controls the direction of air flow through the air cylinder, wherein a cable chain moves the optical fiber as the sensor head moves back and forth and wherein each one of the plurality of measurements is made during a respective one movement of the sensor across the web sheet; and averaging said measurements into a single reading with the controller that receives said signals to average said measurements into a single reading.

6. A method according to claim 5, wherein a housing extends across the cross directional section of the continuous flat sheet, and the method comprises the further step of mounting said sensor head inside the housing.

7. A method according to claim 6, wherein the sensor head is an infrared optical sensor, and the method comprises the further step of conducting optical signals from the optical sensor to a controller to measure moisture content of an area of said continuous flat sheet.

8. A method according to claim 7, wherein a standardization plate is supported by the housing and is located laterally outside said continuous flat sheet, and the method comprises the further steps of:

moving the optical sensor to a position adjacent the standardization plate; and using the standardization plate to calibrate the optical sensor.

9. A method according to claim 5, wherein the sensor head comprises a single sensor that is moved back and forth across said cross directional section.

10. A sheet making machine comprising:

a headbox for receiving and holding a paper slurry;

a forming section for receiving the pulp slurry from the headbox and for forming the slurry into a fiber web;

a drying section for drying the fiber web; and a sensor system for measuring process variables of the fiber web in a machine direction with cross direction averaging;

wherein the sensor system includes:

one or more sensors for taking a plurality or measurements along a cross directional section of the fiber web, and for generating a series of signals representing said measurements;

a driver for moving the one or more sensors back and forth across said cross directional section to make said multitude of measurements, and wherein each one of the multitude of measurements is made during a respective one movement of the one or more sensors across the web sheet; and a controller for receiving said signals and for using said signals to average said measurements into a single reading to generate a representative and stable machine direction reading of the process, wherein said one or more sensors includes a sensor head and wherein:

the sensor head includes an infrared optical sensor;

the driver includes an air cylinder to drive the optical sensor back and forth; and the sensor system further includes:

an optical fiber for conducting optical signals from the optical sensor to the controller;

a solenoid for controlling the direction of air flow through the air cylinder; and a cable chain for moving the optical fiber as the sensor head moves back and forth.

11. A sheet making machine according to claim 10, wherein the sensor system further comprises a standardization plate, and the optical sensor is supported for movement to a position adjacent the standardization plate to calibrate the sensor head.

12. A sheet making machine according to claim 11, wherein:

the sensor system further includes a housing extending across said cross directional section of the continuous flat sheet, and a sensor cartridge assembly releasably mounted inside the housing;

the sensor cartridge assembly includes the optical sensor, the air cylinder, the solenoid, and the cable chain; and the housing includes a base and a cover, said cover being movably connected to the base to provide access to the interior of the housing.

13. A sheet making machine according to claim 10, wherein sensor head comprises a single sensor that is moved back and forth across said cross directional section.

* * * * *